US008225769B2

(12) United States Patent
Dilly

(10) Patent No.: US 8,225,769 B2
(45) Date of Patent: Jul. 24, 2012

(54) INTERNAL COMBUSTION ENGINE HAVING AN ENGINE BRAKE DEVICE

(75) Inventor: Hans-Werner Dilly, Dietenhofen (DE)

(73) Assignee: MAN Truck & Bus AG

( * ) Notice: Subject to any disclaimer, the term of this patent is extended or adjusted under 35 U.S.C. 154(b) by 457 days.

(21) Appl. No.: 12/500,469

(22) Filed: Jul. 9, 2009

(65) Prior Publication Data

US 2010/0006063 A1 Jan. 14, 2010

(30) Foreign Application Priority Data

Jul. 11, 2008 (DE) ..... 10 2008 032 773
Dec. 10, 2008 (DE) ..... 10 2008 061 412

(51) Int. Cl.
*F02D 13/04* (2006.01)

(52) U.S. Cl. ..... 123/321; 123/320; 123/90.12

(58) Field of Classification Search ..... 123/320, 123/321, 322, 319, 90.12, 90.15, 90.16, 90.22, 123/90.25, 90.28, 90.33, 90.36, 90.46, 90.53, 123/90.55, 90.56, 90.57, 90.58, 90.59, 90.23; 701/102, 103

See application file for complete search history.

(56) References Cited

U.S. PATENT DOCUMENTS 2,380,051 A * 7/1945 Kettering ..... 123/90.4
3,140,698 A * 7/1964 Voorhies ..... 123/90.46
3,520,237 A * 7/1970 Engelsmann et al. ..... 396/197
3,809,033 A * 5/1974 Cartledge ..... 123/90.46
4,150,640 A * 4/1979 Egan ..... 123/321
4,677,723 A * 7/1987 Greene, Sr. ..... 29/890.121
4,924,821 A * 5/1990 Teerman ..... 123/90.22
5,150,672 A * 9/1992 Fischer et al. ..... 123/90.22
5,477,824 A * 12/1995 Reedy ..... 123/322
5,526,784 A * 6/1996 Hakkenberg et al. ..... 123/322
5,540,201 A * 7/1996 Feucht et al. ..... 123/322
5,609,133 A * 3/1997 H.ang.kansson ..... 123/321
5,626,116 A * 5/1997 Reedy et al. ..... 123/321
5,680,841 A * 10/1997 Hu ..... 123/322
5,692,469 A * 12/1997 Rammer et al. ..... 123/321
5,794,589 A * 8/1998 H.ang.kansson ..... 123/321
5,829,397 A * 11/1998 Vorih et al. ..... 123/90.12
5,839,453 A * 11/1998 Hu ..... 123/322
5,975,251 A * 11/1999 McCarthy ..... 188/31
6,085,705 A * 7/2000 Vorih ..... 123/90.12
6,125,828 A * 10/2000 Hu ..... 123/568.14
6,152,104 A * 11/2000 Vorih et al. ..... 123/322
6,189,504 B1 * 2/2001 Israel et al. ..... 123/321
6,237,551 B1 * 5/2001 Macor et al. ..... 123/90.15

(Continued)

FOREIGN PATENT DOCUMENTS

WO WO0242612 5/2002

(Continued)

*Primary Examiner* — Stephen K Cronin
*Assistant Examiner* — Raza Najmuddin
(74) *Attorney, Agent, or Firm* — Robert Becker; Robert Becker & Associates

(57) ABSTRACT

An internal combustion engine including at least one exhaust valve for withdrawal of exhaust gas from at least one combustion chamber, and an engine brake device having a hydraulic valve auxiliary control unit by means of which the exhaust valve can be held in a temporarily open position when the engine brake device is actuated. The engine also includes a hydraulic valve play compensation mechanism for the exhaust valve, and an oil channel that for supplying oil to the valve auxiliary control unit is formed between the latter and the valve play compensation mechanism. For compensation of valve play of the exhaust valve, the oil channel can be closed off via a closure unit.

10 Claims, 7 Drawing Sheets

U.S. PATENT DOCUMENTS

| | | | | |
|---|---|---|---|---|
| 6,244,257 | B1 * | 6/2001 | Hu | 123/568.14 |
| 6,253,730 | B1 * | 7/2001 | Gustafson | 123/321 |
| 6,386,160 | B1 | 5/2002 | Meneely et al. | |
| 6,415,752 | B1 * | 7/2002 | Janak | 123/90.12 |
| 6,450,144 | B2 * | 9/2002 | Janak et al. | 123/321 |
| 6,647,954 | B2 * | 11/2003 | Yang et al. | 123/321 |
| 6,883,492 | B2 * | 4/2005 | Vanderpoel et al. | 123/321 |
| 6,983,725 | B2 * | 1/2006 | Persson | 123/90.16 |
| 7,013,867 | B2 * | 3/2006 | Rammer et al. | 123/321 |
| 7,059,282 | B2 * | 6/2006 | Vorih et al. | 123/90.12 |
| RE39,258 | E * | 9/2006 | Cosma et al. | 123/321 |
| 7,152,576 | B2 * | 12/2006 | Vanderpoel et al. | 123/321 |
| 7,673,600 | B2 * | 3/2010 | Yang | 123/90.16 |
| 7,712,449 | B1 * | 5/2010 | Schwoerer | 123/321 |
| 7,789,065 | B2 * | 9/2010 | Yang | 123/321 |
| 7,905,208 | B2 * | 3/2011 | Ruggiero et al. | 123/90.22 |
| 7,909,015 | B2 * | 3/2011 | Yang | 123/321 |
| 7,984,705 | B2 * | 7/2011 | Yang | 123/321 |
| 2002/0157624 | A1 * | 10/2002 | Janak | 123/90.12 |
| 2005/0087170 | A1 * | 4/2005 | Rammer et al. | 123/321 |
| 2005/0211206 | A1 | 9/2005 | Ruggiero et al. | |
| 2006/0081213 | A1 * | 4/2006 | Yang et al. | 123/321 |
| 2007/0144472 | A1 * | 6/2007 | Yang | 123/90.16 |
| 2007/0175441 | A1 * | 8/2007 | Jeong et al. | 123/321 |
| 2009/0288626 | A1 * | 11/2009 | Langewisch | 123/90.46 |
| 2010/0319657 | A1 * | 12/2010 | Dodi et al. | 123/321 |
| 2011/0132298 | A1 * | 6/2011 | Ruggiero et al. | 123/90.12 |
| 2011/0197833 | A1 * | 8/2011 | Vorih et al. | 123/90.12 |

FOREIGN PATENT DOCUMENTS

| | | |
|---|---|---|
| WO | WO2005089274 | 9/2005 |
| WO | WO2007078309 | 7/2007 |

* cited by examiner

INTERNAL COMBUSTION ENGINE HAVING AN ENGINE BRAKE DEVICE

The instant application should be granted the priority date of Jul. 11, 2008 the filing date of the corresponding German patent application 10 2008 032 773.5 as well as the priority date of Dec. 10, 2008, the filing date of German patent application 10 2008 061 412.2.

BACKGROUND OF THE INVENTION

The present invention relates to an internal combustion engine having at least one exhaust valve for the withdrawal of exhaust gas from at least one combustion chamber. The internal combustion engine also includes an engine brake device that is provided with a hydraulic valve auxiliary control unit that is integrated into a connection mechanism for connection of the exhaust valve with a rocker arm. The internal combustion engine is connected to an oil circuit for the supply of oil. By means of the valve auxiliary control unit, when the engine brake device is actuated the exhaust valve is adapted to be held in a temporarily open position.

Internal combustion engines of this general type are described, for example, in EP 0 736 672 B1 and EP 1 526 257 A2. The engine brake devices of these known internal combustion engines are respectively a hybrid type composed of an engine air brake and a decompression brake, which in particular are also designated as EVB (Exhaust Valve Brake). The hydraulic valve auxiliary control unit, with the variant pursuant to EP 0 736 672 B1, is installed in a rocker arm of the connection mechanism, and with the variant pursuant to EP 1 526 257 A2, is installed on one side in a valve bridge of the connection mechanism that actuates two exhaust valves at the same time. The supply of oil to the hydraulic valve auxiliary control unit is effected by means of the readily available oil circuit of the respective internal combustion engine. With both variants, in order to compensate for the play of the exhaust valve separate set screws are provided, with the aid of which the valve play adjustment can be undertaken during engine assembly and thereafter during regular service intervals. This is expensive. If the valve play is inadvertently set too great by the assembly or service personnel, chattering can occur between the rocker arm and the valve bridge, and the danger of damage to the valve drive exists. In addition, the exhaust valve does not open sufficiently, so that a complete exchange of gas cannot be ensured. If the valve play is set too small, there is the danger that in the hot state the valves do not close completely and hence burn out.

It is therefore an object of the present invention to provide an internal combustion engine of the aforementioned general type that enables a reliable and dependable operation while having an assembly and service cost that is as low as possible.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
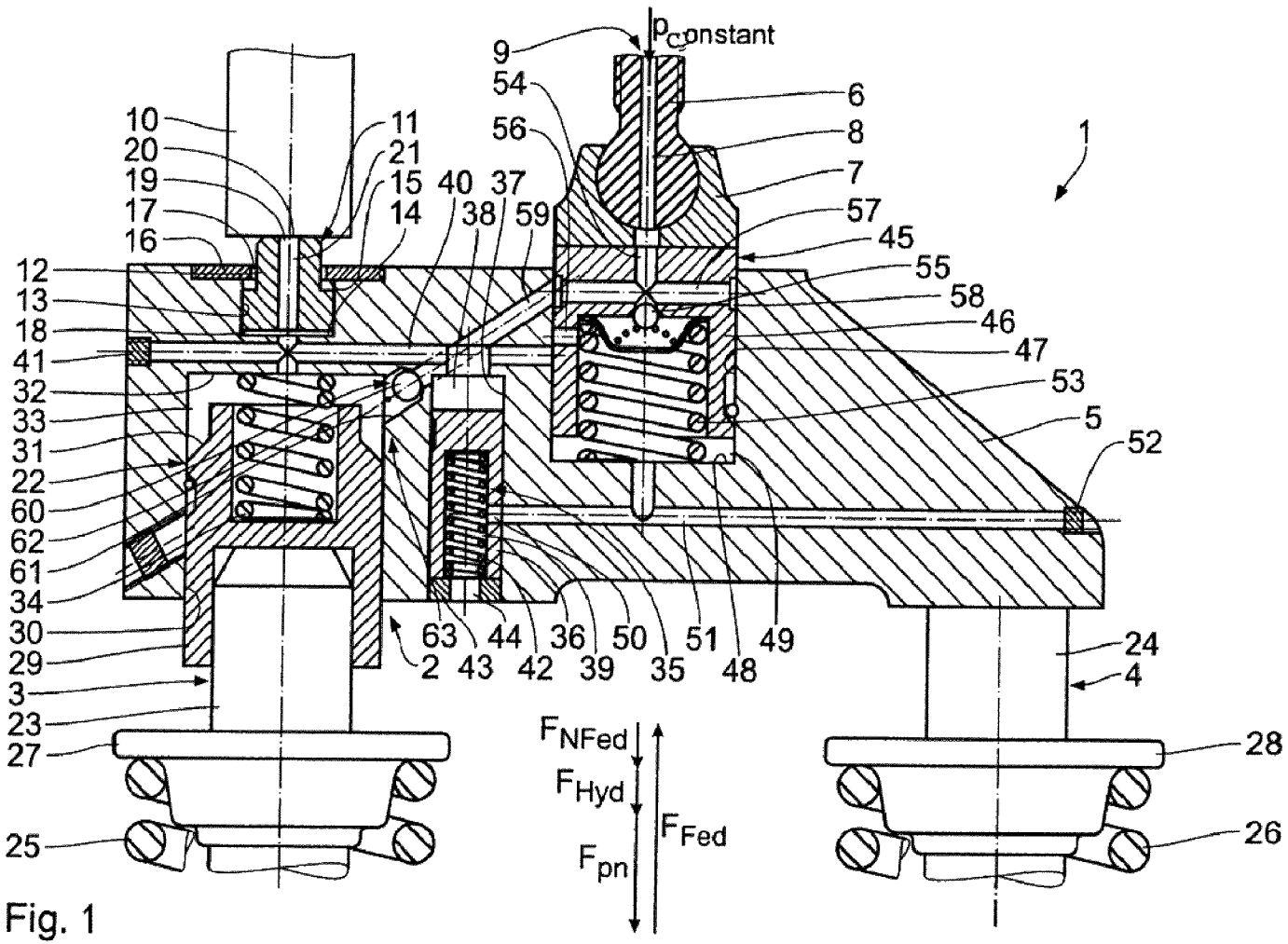
FIG. 1 is a cross-sectional illustration of a valve auxiliary control unit and a valve play compensation mechanism pursuant to a first exemplary embodiment of the present application.

The internal combustion engine of the present invention includes a hydraulic valve play compensation mechanism for the exhaust valve, wherein the valve play compensation mechanism is integrated into the connection mechanism and is connected to the oil circuit that is present anyway for the supply of oil. The hydraulic valve auxiliary control unit is supplied with oil via the valve play compensation mechanism and the oil channel. To compensate for the valve play of the exhaust valve, the oil channel can be closed off by means of the closure unit, so that during the compensation of the valve play, the hydraulic valve auxiliary control unit is not supplied with oil, and the exhaust valve is in a defined position.

The inventive internal combustion engine thus has not only the valve auxiliary control unit that is expedient for the engine braking force effect, but also a compensation mechanism, which automatically carries out the valve play adjustment. A time consuming and costly regular manual adjustment, which is also susceptible to error, becomes unnecessary. Thus, compared with previously known internal combustion engines that are equipped with an engine brake device, the inventive internal combustion engine offers an auxiliary functionality that makes the assembly and operation more reliable and efficient. Due to the automatic valve play adjustment, in particular the chattering of the exhaust valve is minimized, and damage to the valve drive due to a valve play that is set too small is prevented. Furthermore, due to the automatic valve play compensation during operation of the internal combustion engine, no valve play has to be bridged, so that the control times of the exhaust valve can be maintained exactly, resulting in an optimization of the exhaust gas or emission conditions of the internal combustion engine.

Due to the fact that not only the valve auxiliary control unit, but also the valve play compensation mechanism are connected to the oil circuit that is present anyway, internal combustion engines not having a hydraulic valve play compensation mechanism can be retrofitted at a low cost. During the normally fired operation, in other words when the engine brake device has not been actuated by the driver, the oil channel is closed off by means of the closure unit, so that the hydraulic valve auxiliary control unit is uncoupled from the hydraulic valve play compensation mechanism for the compensation of the valve play.

One advantageous further development of the present invention saves space and enables a retrofitting of combustion engines that do not have a hydraulic valve play compensation mechanism by a simple replacement of the valve bridge and integration of the valve play compensation mechanism therein. In particular, the valve auxiliary control unit and the valve play compensation mechanism are integrated into a valve bridge, and the oil channel is formed in the valve bridge.

Pursuant to one embodiment, a first hydraulic piston/cylinder unit enables an automatic play compensation between the valve bridge and a counter support that cooperates with the valve auxiliary control unit. A manual adjustment of the play of the counter support relative to the valve bridge during the assembly or at regular service intervals is not necessary.

A first hydraulic piston/cylinder unit that is connected to the oil circuit and that has a piston integrated into the valve bridge is easy to retrofit and saves space.

Pursuant to another embodiment, a spring element can be disposed between the valve bridge and a counter support that cooperates with the valve auxiliary control unit. Such a spring element prevents an inclined positioning of the valve bridge when the oil pressure of the valve play compensation mechanism is too low.

Pursuant to another embodiment of the present invention, the valve auxiliary control unit can be embodied as a second hydraulic piston/cylinder unit having a piston, wherein the piston is part of the closure unit. Such a valve auxiliary control unit ensures a reliable closing of the oil channel between the valve play compensation mechanism and the valve auxiliary control unit. Since when the engine brake device is not actuated the piston of the second hydraulic piston/cylinder unit is in its retracted normal position, the piston can serve as part of the closure unit, and in the normally fired operation can close off the oil channel. In addition, the closure unit can be provided with a check valve that prevents a retraction of the extended piston if the force on the piston generated by the oil pressure is not sufficient for this purpose.

Pursuant to one embodiment, the piston of the first hydraulic piston/cylinder unit is integrally formed with the piston of the second hydraulic piston/cylinder unit. This embodiment is particularly space saving in that in addition to the auxiliary valve control unit there is also provided a first hydraulic piston/cylinder unit for the compensation of the play between the counter support and the valve bridge. The pistons of the first and second piston/cylinder units are preferably integrally configured in such a way that the piston of the first piston/cylinder unit is guided in the piston of the second piston/cylinder unit.

Pursuant to a further embodiment of the present invention, the valve auxiliary control unit can be connected to the valve play compensation mechanism by means of a third hydraulic piston/cylinder unit. The third hydraulic piston/cylinder unit couples the valve auxiliary control unit and the valve play compensation mechanism to one another in an expedient manner. In this connection, the third hydraulic piston/cylinder unit fulfills several functions. For example, it serves on the one hand as a changeover element between the braking operation and the normally fired operation. On the other hand, it takes up oil or controls oil that is displaced from the first hydraulic piston/cylinder unit during the compensation of the play between the counter support and the valve bridge. Pursuant to a further favorable embodiment, a forward oil receiving chamber of the third hydraulic piston/cylinder unit preferably has a receiving volume that is at least as great as that of an oil pressure chamber of the first hydraulic piston/cylinder unit.

Pursuant to another embodiment, the piston of the second hydraulic piston/cylinder unit has at least one transversely extending through-bore, which cooperates with a circumferential groove. Such a through-bore enables the reduction of the oil pressure in a control pressure chamber of the second piston/cylinder unit when the piston of the first piston/cylinder unit returns from an extended position into a retracted normal position, and when after a return stroke of the piston of the second piston/cylinder unit, the piston of the first piston/cylinder unit is in an upper dead center position and during the following stroke of the valve bridge butts against the counter support. A plurality of through-bores are preferably distributed over the periphery of the piston, and are interconnected via a circumferential groove formed in the piston and/or in the valve bridge. The circumferential groove increases a discharge cross-section, and enables the formation of a precise edge for the control.

Pursuant to one embodiment that has proven itself in practice, the valve play compensation mechanism can be embodied as a fourth piston/cylinder unit.

Pursuant to another embodiment of the present invention, the third piston/cylinder unit can be disposed on a side of the first piston/cylinder unit that faces away from the valve play compensation mechanism. Such an arrangement of the third piston/cylinder unit increases the stability of the valve bridge, since the third piston/cylinder unit is not disposed in the region between the exhaust valves that during actuation of the exhaust valves is loaded by bending moments. A forward oil receiving chamber of the third piston/cylinder unit is preferably coupled with the second piston/cylinder unit, and a rear oil receiving chamber is preferably coupled with the first piston/cylinder unit, whereby disposed between the first piston/cylinder unit and the second piston/cylinder unit is a check valve that acts in a blocking manner for an oil flow in a direction of the second piston/cylinder unit. By a suitable dimensioning of the third piston/cylinder unit, slight control leakage quantities and hence slight jump lengths of the piston of the third piston/cylinder unit can be achieved. In this way, a low overall height of the third piston/cylinder unit is possible.

An embodiment where a piston of the third piston/cylinder unit is integrally formed with the piston of the first piston/cylinder unit is particularly space saving. Preferably, the first, the second and the third piston/cylinder units are integrally formed. The piston of the second piston/cylinder unit is, for example, guided in the valve bridge, whereby the piston of the first piston/cylinder unit is disposed and guided therein or in an auxiliary part disposed in the valve bridge. The piston of the third piston/cylinder unit is in turn arranged and guided in the piston of the first piston/cylinder unit. A low overall height of the valve bridge can be achieved with such a stacking of the piston/cylinder units. By means of a suitable dimensioning of the third piston/cylinder unit, slight control leakage quantities and hence slight jump lengths of the piston of the third piston/cylinder unit can be achieved. As a result, a low overall height of the third piston/cylinder unit is possible.

Further specific features of the present invention will be described in detail subsequently.

DESCRIPTION OF SPECIFIC EMBODIMENTS

Referring now to the drawings in detail, a first embodiment of the invention is described subsequently with the aid of FIG. 1. An internal combustion engine 1 having an engine brake device 2 is provided with a plurality of cylinders, which are not shown in FIG. 1 and which each delimit a combustion chamber. Air or an air/fuel mixture can be supplied to each of these combustion chambers by means of at least one intake valve. Furthermore, each combustion chamber has two exhaust valves 3 and 4, by means of which the exhaust gas can be withdrawn from the combustion chamber into the exhaust gas channel. The exhaust valves 3 and 4 can be mechanically controlled and operated by means of a common valve bridge 5. The valve bridge 5 is part of a connection mechanism that connects the exhaust valves 3 and 4 with a camshaft of the internal combustion engine 1, which is not illustrated in FIG. 1. The connection mechanism also includes a pivotably mounted rocker arm, which is also not illustrated in FIG. 1. By means of a partially illustrated contact bolt or rod 6, the rocker arm acts upon the valve bridge 5. For this purpose, the free end of the contact rod 6 is provided with a cup-shaped support 7 that is linked via a ball-and-socket joint.

Extending in the interior of the contact rod 6 and the cup-shaped support 7 is an oil supply channel 8 of an oil circuit 9 of the internal combustion engine 1 provided not only for lubrication but also for the hydraulic control. During operation, the oil conveyed in this oil supply channel 8 has nearly the same oil pressure $P_{constant}$. The dependency of the oil pressure $P_{constant}$ upon the oil temperature, the speed and the load is negligible with the inventive internal combustion engine 1.

A first hydraulic piston/cylinder unit 11 is provided to compensate for play between a counter support 10 and the valve bridge 5. The first piston/cylinder unit 11 has a first piston 12, which when viewed in a longitudinal cross-section has a T-shaped configuration; the first piston 12 is guided in a first cylinder bore 13 that is formed in the valve bridge 5 and acts as a cylinder. The first piston 12 is axially movably guided between a forward delimiting surface 14, which acts as an abutment, and a rear delimiting surface 15, which also acts as an abutment. The rear delimiting surface 15 is formed, for example, by a threaded disk 16 that is threaded into the valve bridge 5 and that is provided with a through-opening 17 for the first piston 12. In the position of the first piston 12 shown in FIG. 1, an oil pressure chamber 18 is formed between the first piston 12 and the forward delimiting surface 14. The first piston 12 has a central through-bore 19, which on a side facing the counter support 10 forms a gradual shutoff opening 20. The through-bore 19 is part of a first oil channel 21, which connects the oil pressure chamber 18 with the gradual shutoff opening 20.

The engine brake device 2 of the internal combustion engine 1 is of the EVB (Exhaust Valve Brake) type, and, in addition to a throttle element in the exhaust gas channel (not shown in FIG. 1) as well as a central control/regulation unit (also not shown), also includes, for each cylinder, a hydraulic valve auxiliary control unit 22, which is formed as a second hydraulic piston/cylinder unit. During engine braking operation, the valve auxiliary control unit 22 cooperates solely with the exhaust valve 3. In contrast, the exhaust valve 4 is not provided with a corresponding valve auxiliary control unit 22. The exhaust valves 3 and 4 are axially movably mounted in a cylinder head via a shaft or stem 23 and 24 respectively, and are biased in a closing direction by a closure spring 25 or 26 respectively having a specified preloading. The closure springs 25 and 26 are held between the cylinder head and valve spring seats 27 and 28 respectively. The closure force of the closure spring 25 is designated $F_{Fed}$.

The valve auxiliary control unit 22 is provided with a second piston 29 that acts as a control piston and is axially movably guided in a second cylinder bore 30, which is formed in the valve bridge 5 and acts as a cylinder. The second piston will subsequently be designated as the control piston 29. The control piston 29 is supported against the upper end of the stem 23 of the exhaust valve 3. On a side facing away from the exhaust valve 3, the control piston 29 has a reduced diameter, i.e. is tapered, and forms an annular surface 31 that extends at an angle. In the position of the control piston 29 shown in FIG. 1, a control pressure chamber 33 is formed between a delimiting surface 32 of the valve auxiliary control unit 22 and the control piston 29. Disposed in the control pressure chamber 33 is a reset spring 34, which rests against the delimiting surface 32 and the control piston 29 and presses the control piston against the stem 23. The spring force of the reset spring 34 thus acts counter to the closure force $F_{Fed}$ of the closure spring 25, and is subsequently designated as $F_{NFed}$. The first oil channel 21 opens out into the control pressure chamber 33 at the delimiting surface 32, so that oil can escape out of the control pressure chamber 33 through the gradual shut-off opening 20 when the gradual shutoff opening is freed by the counter support 10 upon activated engine brake device 2 during a portion of a braking cycle period. In FIG. 1, an operating situation is illustrated in which the counter support 10 closes off the gradual shutoff opening 20 and hence the control pressure chamber 33.

The valve auxiliary control unit 22 is hydraulically connected to a third hydraulic piston/cylinder unit 35, which is provided with a third piston 36 that in a longitudinal cross-section has a U-shaped configuration and that is axially movably guided in a third cylinder bore 37 which is formed in the valve bridge 5 and acts as a cylinder. The third piston 36 divides the third cylinder bore 37 into a forward oil receiving chamber 38 and a rear oil receiving chamber 39. The forward oil receiving chamber 38 is connected with the control pressure chamber 33 by means of a second oil channel 40, which is formed by a transverse bore that extends within the valve bridge 5 and passes through the first oil channel 21. The transverse bore is provided with a closure or plug 41. Disposed in the rear oil receiving chamber 39 is a return spring 42 that rests against the third piston 36 and an abutment element 43. The abutment element 43 has an oil discharge opening 44 for the withdrawal of oil from the rear oil receiving chamber 39.

The third piston/cylinder unit 35 is a changeover element, the piston positions of which differ depending upon whether the user of the internal combustion engine prescribes the normally fired engine operation or the engine braking operation. The forward oil receiving chamber 38 serves for receiving the oil found in the oil pressure chamber 18 when this oil is displaced by a forward movement of the first piston 12. The maximum receiving volume of the forward oil receiving chamber 38 is therefore at least at great as that of the oil pressure chamber 18.

The third piston/cylinder unit 35 is connected to a hydraulic valve play compensation mechanism 45, which is embodied as a fourth piston/cylinder unit. The hydraulic valve play compensation mechanism 45 automatically compensates for the play of the exhaust valves 3 and 4, and will subsequently be designated as the fourth piston/cylinder unit 45. The fourth piston/cylinder unit 45 is provided with a fourth piston 46, which in a longitudinal cross-section has a U-shaped configuration and is axially movably guided in a fourth cylinder bore 47 that is formed in the valve bridge 5 and acts as a cylinder. In the position of the fourth piston 46 shown in FIG. 1, an oil receiving chamber 49 is formed between the fourth piston 46 and a delimiting surface 48. The oil receiving chamber 49 is hydraulically connected with the rear oil receiving chamber 39. For this purpose, a gradual shutoff opening 50 is provided in a side wall of the third piston 36. At a certain position of the third piston 36, namely precisely in the position shown in FIG. 1, the gradual shut-off opening 50 connects the rear oil receiving chamber 39 with the oil receiving chamber 40 by means of a third oil channel 51. The third oil channel 51 is formed by a transverse bore formed in the valve bridge 5 and by a longitudinal bore. The transverse bore opens out into the third cylinder bore 37 and is sealed off by a closure or plug 52. Proceeding from the delimiting surface 48, the longitudinal bore extends to the transverse bore. Disposed in the oil receiving chamber 49 is a reset spring 53, which rests against the delimiting surface 48 and the fourth piston 46.

The fourth piston/cylinder unit 45 is connected to the oil circuit 9. For this purpose, the head of the fourth piston 46, which is in permanent contact with the cup-shaped support 7 of the contact rod 6 due to the piston force action of the reset spring 53, is provided with a central oil supply channel 54, which corresponds with the oil supply channel 8 of the contact rod 6. Provided at the one end of the oil supply channel 54 that faces the oil receiving chamber 49 is a check valve 55 (non-return valve), the ball of which, in the illustrated embodiment, is pressed into the ball seat by means of an additional check valve spring. A side wall of the fourth piston 46 is provided with a gradual shutoff opening 56, which at a certain position of the fourth piston 46 connects the oil receiving chamber 49 with the second oil channel 40.

In the region between the cup-shaped support 7 and the check valve 55, a through-bore 57 that extends transverse to the oil supply channel 54 is formed in the fourth piston 46. The through-bore 57 passes through the oil supply channel 54. A circumferential groove 58 formed in the fourth piston 46 connects the ends of the through-bore 57. In a certain position of the fourth piston 46, namely the position shown in FIG. 1, the through-bore 57 is connected with the control pressure chamber 33 by means of a fourth oil channel 59. The fourth oil channel 59 extends at an angle within the valve bridge 5, and does not pass through the second oil channel 40. Disposed at a side of a fourth oil channel 59 that faces the control pressure chamber 33 is a check valve 60 having a ball 62 that can be received in a ball seat 61. The control piston 29 and the check valve 60 are part of a closure unit 63, by means of which the fourth oil channel 59 can be closed off, so that the valve play of the exhaust valves 3 and 4 can be compensated for by means of the fourth piston/cylinder unit 45.

The operation of the engine brake device 2 as well as of the valve play compensation mechanism 45, designated as piston control, will be described in detail subsequently.

The engine braking operation will first be explained. Upon actuation of the engine brake device 2, the throttle element in the exhaust gas channel is brought into the throttle position, as a result of which the exhaust gases in the exhaust gas channel back up between the exhaust valve opening of the cylinder and the throttle element. This back-up pressure in the exhaust gas channel with the pressure wave of the opening exhaust valves of the adjacent cylinders effects a temporary opening of the exhaust valve 3, which occurs during the compression stroke and the expansion stroke of each four-stroke cycle of the internal combustion engine 1. Due to the pressure conditions existing in the combustion chamber of the cylinder and in the exhaust gas channel, there results a pneumatic force $F_{pn}$, which counteracts the closure force $F_{Fed}$ of the closure spring 25 and leads to the aforementioned temporary opening of the exhaust valve 3. The spring force $F_{NFed}$ of the reset spring 34 follows the control piston 29 of the exhaust valve 3 up and supports the temporary opening of the exhaust valve 3.

During the intake stroke, the rocker arm of the exhaust valves 3 and 4 is disposed on the cam base circle of the camshaft. As a result, the fourth piston 46 is at its upper dead center position. The gradual shutoff opening 56 is closed. The through-bore 57 is connected with the fourth oil channel 59. This operating situation is shown in FIG. 1.

If the sum of the pneumatic force $F_{pn}$ and of the spring force $F_{NFed}$ is greater than the closure force $F_{Fed}$ of the closure spring 25, the temporary opening of the exhaust valve 3 is effected. During the temporary opening of the exhaust valve 3, the control piston 29, due to the spring force $F_{NFed}$ of the reset spring 34, follows the opening movement of the exhaust valve 3, as a result of which at the same time the volume of the control pressure chamber 33 is increased. The tapered portion of the control piston 29 serves to make the oil required for the movement available to the control piston 29 via the fourth oil channel 59. Due to the movement of the control piston 29, which is part of the closure unit 63, the control piston 29 opens the fourth oil channel 59. The fourth oil channel 59 is now no longer closed. Due to the underpressure resulting in the control pressure chamber 33, oil flows through the oil supply channels 8, 54, the through-bore 57, and the fourth oil channel 59 into the control pressure chamber 33, as a result of which a hydraulic force $F_{Hyd}$ acts upon the control piston 29 and supports the reset spring 34. Since due to the check valve 60 the oil cannot flow back out of the control pressure chamber 33 into the fourth oil channel 59, and since the gradual shutoff openings 20 and 56 are closed, the control piston 29 is held in position against the closure force $F_{Fed}$ of the closure spring 25, and thus also the exhaust valve 3, which is mechanically coupled with the control piston 29, is held in the temporarily opened position. The control piston 29 is thus hydraulically blocked in the valve bridge 5. Thus, during the second stroke (compression stroke) and the following forward stroke (expansion stroke), the exhaust valve 3 remains in the temporarily opened position, as a result of which the desired engine braking effect is established.

At the end of the third stroke the rocker arm again loads the valve bridge 5 due to the camshaft control in order to bring the exhaust valves 3 and 4 into the completely opened position provided during the fourth stroke. Due to the loading by the rocker arm, the valve bridge 5 moves away from the counter support 10, so that the contact between the counter support 10 and the first piston 12 is broken, and the gradual shutoff opening is opened. After opening of the gradual shutoff opening 20, the fourth piston 46 is pressed downwardly in a direction of its lower dead center position, so that the gradual shutoff opening 56 opens. The oil pressure $p_{constant}$ is too small to hold the control piston 29 in its position. The oil found in the control pressure chamber 33 can, via the first oil channel 21, flow out through the shutoff opening 20 into the region of the cylinder cover. In so doing, the hydraulic blocking of the control piston 29 is eliminated. The oil discharge out of the control pressure chamber 33 is also supported in that due to the closure force $F_{Fed}$ of the closure spring 25, the control piston 29 is pressed back into its upper dead center position. During the movement back of the control piston 29, due to the oil leaving the shutoff opening 20 the first piston 12 is pressed into its upper dead center position. Furthermore, during the moving back of the control piston 29, the oil presses the ball 62 into the ball seat 61, so that the check valve 20 closes off the fourth oil channel 59.

During the return stroke of the rocker arm, after the renewed contact between the counter support 10 and the first piston 12, the first piston is pushed back in the direction of its upper dead center position until the valve bridge 5 is in its upper dead center position. The oil in the oil pressure chamber 18 can, due to the contact with the counter support 10, no longer escape through the shut off opening 20 and flows via the second oil channel into the forward oil receiving chamber 38, as a result of which the resulting oil pressure pushes the third piston 36 back into its lower dead center position and the gradual shut off opening 50 is opened. Since the fourth piston 46 is in its lower dead center position, the oil in the forward oil receiving chamber 38 can flow off via the shutoff opening 56, the oil receiving chamber 49, the third oil channel 51, the shutoff opening 50, the rear oil receiving chamber 39, and the oil discharge opening 44. The receiving volume of the forward oil receiving chamber 38 must be adequately large for receiving the oil flowing out of the oil pressure chamber 18, so that the oil flowing out of the oil pressure chamber 18 does not back up and lead to an undesired movement of the control piston 29. The receiving volume of the forward oil receiving chamber 38, however, must not exceed a maximum receiving volume, so that the third piston 36 passes reliably into its lower dead center position. On the other hand, during a subsequent movement of the control piston 29 for the temporary opening of the exhaust valve 3, the control pressure chamber 33, due to the still possible residual stroke of the third piston 36, is elastic and cannot hold the exhaust valve 3 in the temporarily opened position. At the end of the fourth stroke (exhaust stroke), the first piston 12 again rests against the counter support 10 and the rocker arm has again reached the cam base circle. The fourth piston 46 returns to its upper dead center position, whereby the gradual shutoff opening 56 is closed. A new braking cycle can begin.

Due to the fact that the first piston 12 can be hydraulically reset, an abutment play between the counter support 10 and the valve bridge 5 is automatically compensated for. This is advantageous since the precise position of the valve bridge 5, due to the valve play compensation effected by the fourth piston/cylinder unit 45, is not defined exactly. Due to the automatic resetting of the first piston 12, its position is adapted to the respective actual or current position of the valve bridge 5, so that no play remains between the counter support 10 and the first piston 12, and the shutoff opening 20 is reliably closed.

The fourth piston 46, which is primarily intended for the valve play compensation, fulfills further functions for the internal combustion engine 1. It is in particular a control element for the (EVB) engine braking cycle, and a flow element for supplying the valve auxiliary control unit 22 with oil from the oil circuit 9.

Furthermore, the bore configuration provided in the valve bridge 5 is expedient. It enables, in particular, a use of the oil not only for the functional movement, for example in order to bring the exhaust valve 3 into the temporarily opened position and to hold it there, but also for the hydraulic control of the various mechanically moved components. For example, it can be advantageous for the longitudinal axes of the stem 23, the control piston 29, the control pressure chamber 33, the first piston 12, and the oil pressure chamber 18 to be aligned with one another.

The normally fired engine operation will be explained in the following. In the normally fired engine operation, the throttle element in the exhaust gas channel remains in the opened position. During the intake stroke, the rocker arm of the exhaust valves 3 and 4 is located on the cam base circle. As a result, the fourth piston 46 is in its upper dead center position, as a result of which the gradual shut off opening 56 is closed. During the first to the third strokes, the exhaust valve 3, due to the closure force $F_{Fed}$ of the closure spring 25, remains in its closed position, as a result of which the control piston 29 is in its upper dead center position. Consequently, the fourth oil channel 59 is closed. Thus, oil from the oil circuit 9 can flow via the oil supply channels 8 and 54 into the oil receiving chamber 49, the third oil channel 51, and the fourth oil channel 59. Due to the fact that the third piston 36 is in its upper dead center position, as a result of which the shutoff opening 50 is closed, no oil can escape out of the oil receiving chamber 49 through the third oil channel 51. At the same time, via the through-bore 57 and the fourth oil channel 59, no oil can pass into the control pressure chamber 33 and unintentionally open the exhaust valve 3, since the control piston 29, as part of the closure unit 63, closes off the fourth oil channel 59. Such a quantity of oil from the oil circuit 9, which is under the constant oil pressure $p_{constant}$, flows into the oil receiving chamber 49 that the actual valve play is compensated for by the hydraulic resetting of the fourth piston 46, which is caused by the reset spring 53. This is also effected automatically. Only very small quantities of oil are involved. Therefore, the ball of the check valve 55 is held in the ball seat by means of a separate spring. Leakage at the fourth piston 46 is compensated for by follow-up oil from the oil circuit 9.

Due to the fact that in normally fired engine operation the fourth oil channel 59 is closed off by the control piston 29, the valve auxiliary control unit 22 is uncoupled from the fourth piston/cylinder unit 45, whereby the control piston 29 reliably remains in its upper dead center position. The exhaust valve 3 and valve bridge 5 thus have a defined position for the compensation of the valve play.

With the internal combustion engine 1, during assembly of the engine, and also during the later operation, no adjustment of the valve play and also of the abutment play (EVB-play) between the counter support 10 and valve bridge 5 are carried out. The compensation of these two plays is effected automatically on the basis of the configuration of the engine brake device 2 and of the valve play compensation mechanism (fourth piston/cylinder unit 45) that are particularly favorable in this regard. In particular, there is also effected an automatic compensation of the thermal expansion of the exhaust valves 3 and 4. Since no play has to be bridged, the theoretically prescribed control time points can be maintained exactly. This also has a favorable effect upon the emission values. In addition, the compensation of the valve play and of the EVB-play reduces the generation of noise by the internal combustion engine 1. Acoustical advantages result.

In principle, the described compensation mechanisms can also be utilized for the intake valves. The components used with the internal combustion engine 1 are not specialized components. Thus, for example, the basic construction of the valve bridge 5 can also be used with other internal combustion engines that are not equipped with a motor brake device. The valve bridge 5 then contains only the fourth piston/cylinder unit 5 with a fourth piston 46 without a gradual shutoff opening 56 and a through-bore 57. The further piston/cylinder units 11, 22 and 35 can be eliminated.

Figure 2:
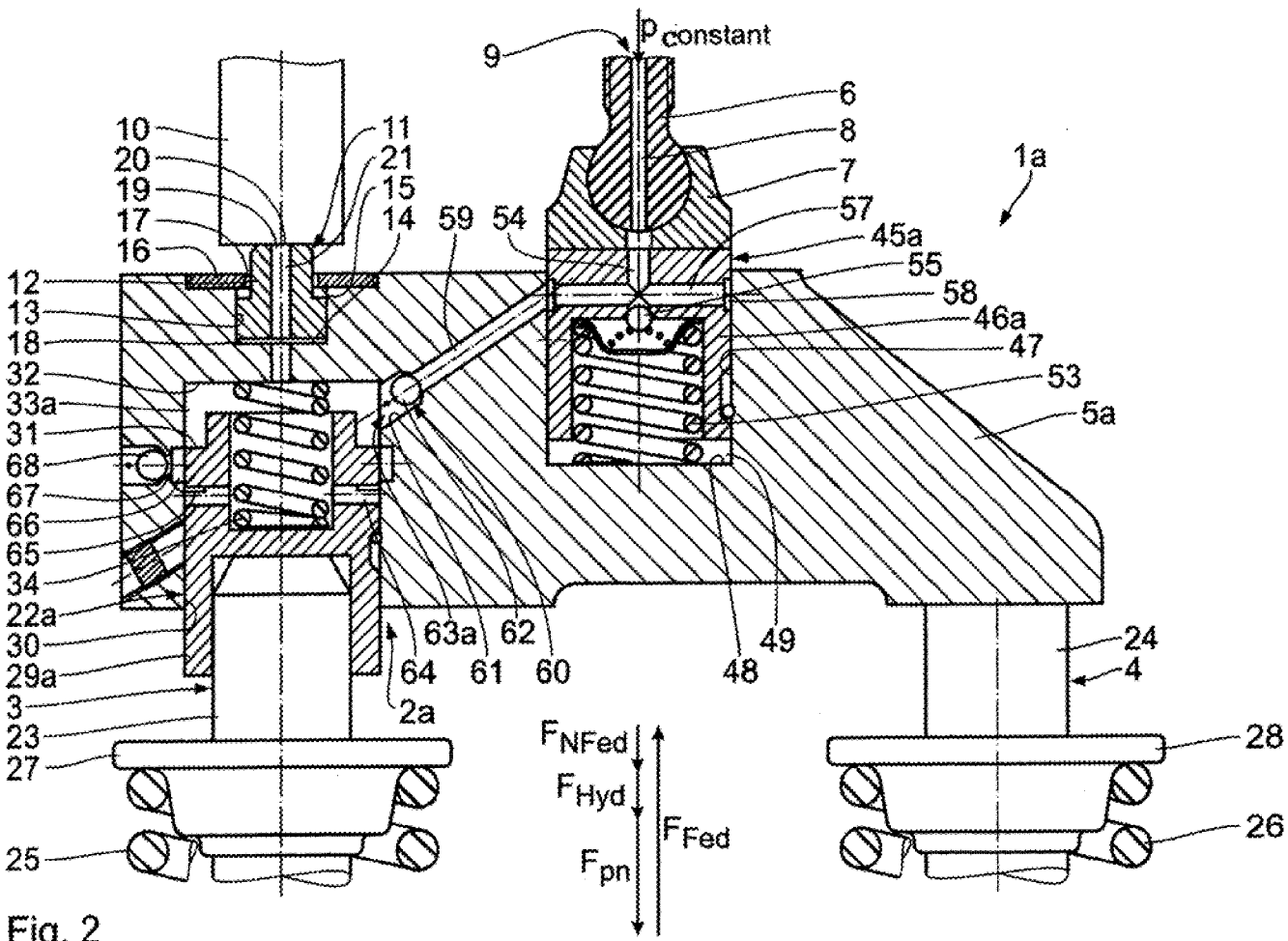
FIG. 2 is a cross-sectional illustration of a valve auxiliary control unit and a valve play compensation mechanism pursuant to a second exemplary embodiment of the present application.

A second embodiment of the invention will be described subsequently with the aid of FIG. 2. Structurally identical components have the same reference numerals as with the first embodiment, the description of which is hereby made reference to. Structurally different, yet functionally identical components have the same reference numerals followed by the letter a. In contrast to the first embodiment, with the second embodiment, the third piston/cylinder unit 35, the second oil channel 40 and the third oil channel 51, as well as the gradual shut off opening 56, are eliminated. Formed in the valve bridge **5*a* of the internal combustion engine 1*a* are merely the first oil channel 21 and the fourth oil channel 59. The oil supply channel 54 and the through-bore 57 are formed in the fourth piston 46*a* in the manner already described. On that side facing the control pressure chamber 33*a*, the control piston 29*a* is provided with a transversely extending through-bore 64. The peripheral ends of the through-bore 64 are interconnected by a circumferential groove 65 that is formed in the control piston 29*a*. Formed in the valve bridge 5*a*, in the region of the control pressure chamber 33*a*, is a further circumferential groove 66 that is connected with a gradual shutoff opening 67, which can be closed off in the direction of the control pressure chamber 33*a* by means of a check valve 68**.

The engine braking operation will first be explained. The blocking of the exhaust valve 3 in the temporarily opened position when the engine brake device 2*a* is actuated is effected in the already-described manner. In the temporarily opened position of the exhaust valve 3, the control piston 29*a* closes off the gradual shutoff opening 67, so that no oil can escape from the control pressure chamber 33*a*. This operating situation is shown in FIG. 2. When at the end of the third stroke the rocker arm again loads the valve bridge 5*a* based on the camshaft control in order to bring the exhaust valve 3 into the completely opened position provided during the fourth stroke, the piston 12 is raised from the counter support 10, thus releasing the gradual shutoff opening 20. The oil found in the control pressure chamber 33*a* can now flow off through the shutoff opening 20 via the first oil channel 21. The hydraulic blocking of the control piston 29*a* is released. The control piston 29*a* moves back into its upper dead center position, whereby the gradual shutoff opening 67 releases the through-bore 64. At the same time, the first piston 12 moves into its upper dead center position. During the return stroke of the rocker arm, and after the renewed contact closure between the counter support 10 and the first piston 12, the piston 12 is displaced back in the direction of its upper dead center position. The oil displaced in the oil pressure chamber 18 can escape via the first oil channel 21, the control pressure chamber 33*a*, the through-bore 64, and the shutoff opening 67. The circumferential grooves 65 and 66 increase the withdrawal cross-section for the discharging oil, and contribute to an exact gradual shutoff of the oil as a function of the stroke of the control piston 29*a*. At the end of the fourth stroke, the counter support 10 again rests against the first piston 12, and the rocker arm has again reached the cam base circle. The EVB-play is compensated for, and a new braking cycle can begin.

During the normally fired engine operation, the control piston 29*a* is in its upper dead center position, so that the fourth oil channel 59 is closed. Thus, as with the first embodiment, the control piston 29*a* forms a part of the closure unit 63*a*. The exhaust valve 3 and the valve bridge 5*a* thus have a defined position for the valve play compensation. The compensation of the valve play by means of the fourth piston 46*a* is effected in the already described manner, whereby a stroke movement of the fourth piston 46*a* is solely required for the valve play compensation. Since during the valve play compensation only slight stroke movements are required, the through-bore 57 is constantly connected with the fourth oil channel 59. With regard to the further operation of the valve auxiliary control unit 22*a* and of the valve play compensation mechanism (fourth piston/cylinder unit 45*a*), reference is made to the first embodiment. The operation of the second embodiment is also designated as an edge control.

Figure 3:
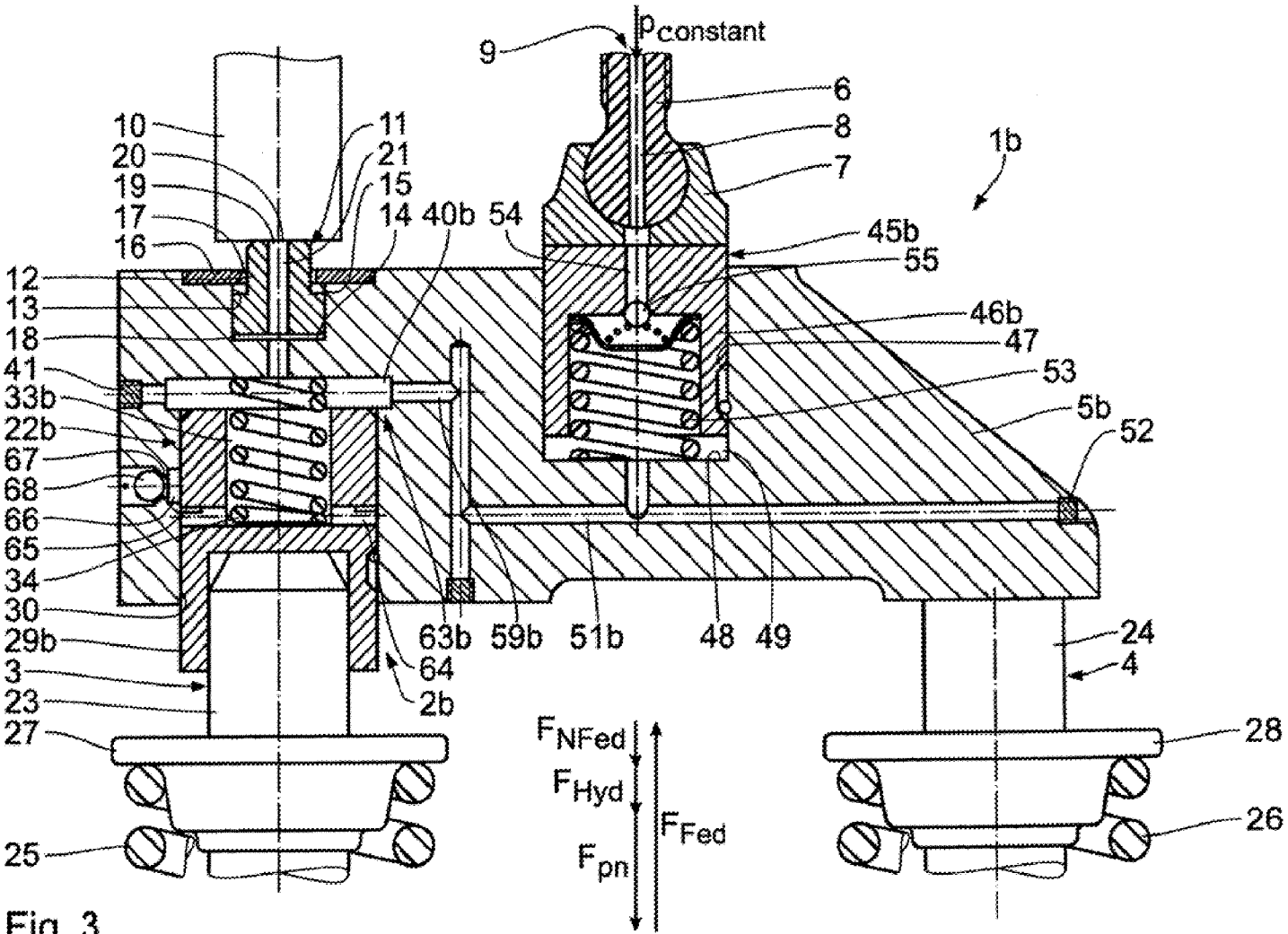
FIG. 3 is a cross-sectional illustration of a valve auxiliary control unit and a valve play compensation mechanism pursuant to a third exemplary embodiment of the present application.

A third embodiment of the invention will be described subsequently with the aid of FIG. 3. Structurally identical components have the same reference numerals as with the preceding embodiments, to the description of which reference is hereby made. Structurally different, yet functionally identical components have the same reference numerals followed by the letter b. In contrast to the first embodiment, with the third embodiment the third piston/cylinder unit 35, the gradual shutoff opening 56, the through-bore 57, and the check valve 60 are eliminated. The fourth oil channel 59*b* connects the third oil channel 51*b* with the second oil channel 40*b*. The second oil channel 40*b* is connected with the control pressure chamber 33*b* over the entire width of the control piston 29*b*, and in the region of the upper dead center position of the control piston 29*b* forms a rectangular circumferential groove. In conformity with the second embodiment, the control piston 29*b* is provided with the through-bore 64 and the circumferential groove 65. Furthermore, in conformity with the second embodiment the valve bridge 5*b* is provided with the circumferential groove 56 as well as the gradual shutoff opening 67 having the check valve 68. In conformity with the preceding embodiments, a check valve 60, which is not illustrated in FIG. 3, can be disposed in the fourth oil channel 59*b*.

The engine braking operation will first be explained. During the temporary opening of the exhaust valve 3, the movement of the control piston 29*b* produces an underpressure in the control pressure chamber 33*b*, as a result of which oil is drawn out of the oil receiving chamber 49 of the fourth piston/cylinder unit 45*b* via the third oil channel 51*b*, the fourth oil channel 59*b* and the circumferential groove of the second oil channel 40*b*. The oil flowing out of the oil receiving chamber 49 flows in subsequently via the oil supply channels 8, 54 and the check valve 55. In the temporarily opened position, the control piston 29*b* closes off the gradual shutoff opening 67. This operating situation is shown in FIG. 3. Due to the fact that no oil can any longer flow out of the control pressure chamber 33*b*, the exhaust valve 3 is blocked in the temporarily opened position. When at the end of the third stroke the rocker arm again loads the valve bridge 5*b* based on the camshaft control in order to bring the exhaust valve 3 into the completely open position provided in the fourth stroke, the counter support 10 is raised from the first piston 12, thus releasing the gradual shutoff opening 20. The oil found in the control pressure chamber 33*b* can now flow off through the shutoff opening 20 via the first oil channel 21, thereby releasing the blocking of the control piston 29*b*. The control piston 29*b* moves back into its upper dead center position. In this position, the through-bore 64 is released by the gradual shutoff opening 67, and the fourth oil channel 59*b* is closed off by the control piston 29*b* the control piston 29*b* thus forms the closure unit 63*b*. At the same time the first piston 12 moves into its upper dead center position.

During the return stroke of the rocker arm, and after the renewed contact closure between the counter support 10 and the first piston 12, the gradual shutoff opening 20 is closed off, and the first piston 12 is displaced back in the direction of its upper dead center position until the valve bridge 5*b* is in its upper dead center position. The oil displaced out of the oil pressure chamber 18 is gradually shutoff via the first oil channel 21, the control pressure chamber 33*b*, the through-bore 64, and the shutoff opening 67, in conformity with the second embodiment. At the end of the fourth stroke, the counter support 10 again rests against the first piston 12, and the rocker arm has again reached the cam base circle. The EVB-play is compensated for, and a new braking cycle can begin.

In the normally fired engine operation, the control piston 29*b* is in its upper dead center position, so that the control piston 29*b* acts as a closure element 63*b* for the fourth oil channel 59*b*. The oil pressure produced in the oil receiving chamber 49 due to the stroke movement of the rocker arm cannot move the control piston 29*b* out of its upper dead center position, and thus cannot open the fourth oil channel 59*b*. The exhaust valve 3 and the bridge 5*b* thus have a defined position for the valve play compensation. The valve play compensation is effected in the already described manner, whereby a stroke movement of the fourth piston 46*b* is merely required for the valve play compensation. The fourth piston 46*b* and the closure unit 63*b* are simplified in this embodiment in comparison to the preceding embodiments. With regard to the further operation of the valve auxiliary control unit 22*b* and the valve play compensation mechanism (fourth piston/cylinder unit 45*b*), reference is made to the preceding embodiments. The operation of this embodiment is also designated as an edge control.

Figure 4:
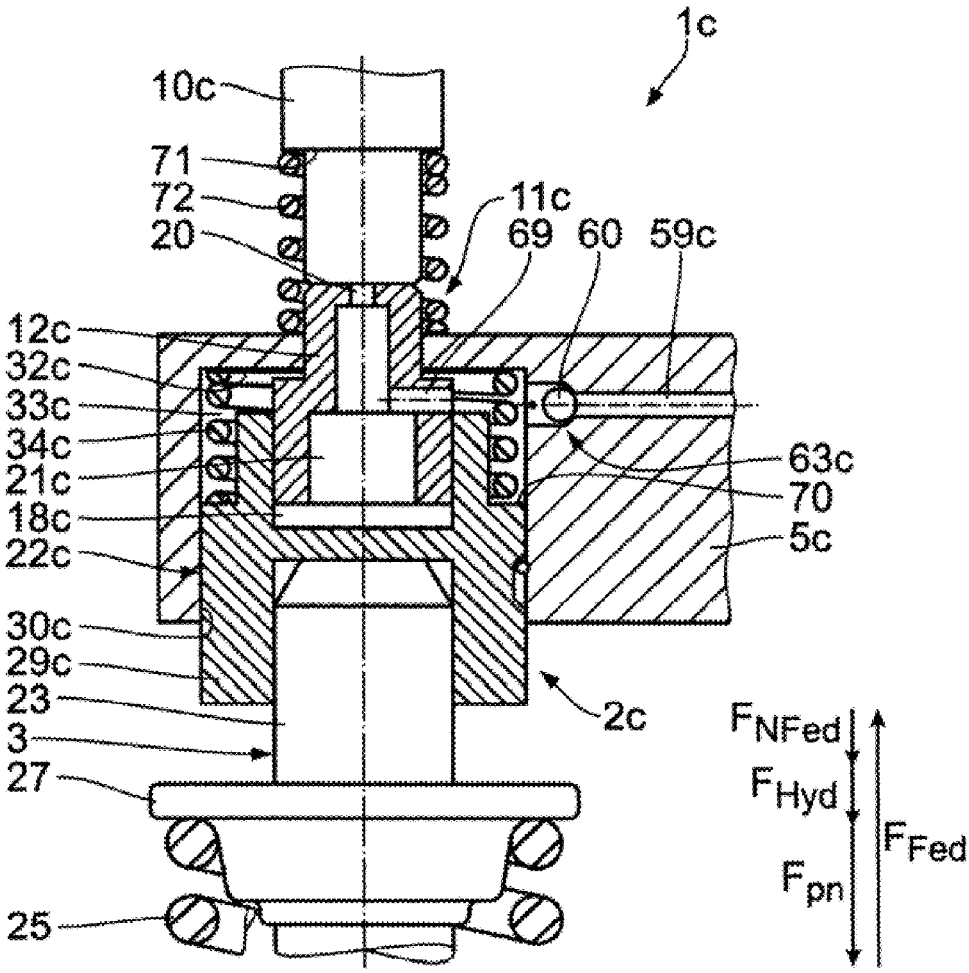
FIG. 4 is a cross-sectional illustration of a valve auxiliary control unit pursuant to a fourth exemplary embodiment of the present application.

A fourth embodiment of the invention will be described subsequently with the aid of FIG. 4. Structurally identical components have the same reference numerals as with the preceding embodiments, to the description of which reference is hereby made. Structurally different, yet functionally identical components have the same reference numerals, followed by the letter c. The essential difference relative to the preceding embodiments is that the first piston/cylinder unit 11*c* is integrated with the second piston/cylinder unit (valve auxiliary control unit 22*c*). The first piston 12*c* is axially movably guided in the control piston 29*c*, which acts as a cylinder. The oil pressure chamber 18*c* is delimited by the first piston 12*c* and the control piston 29*c*. The first oil channel 21*c* has a stepped configuration in the first piston 12*c*, and connects the oil pressure chamber 18*c* with the gradual shutoff opening 20. The first oil channel 20*c* is connected with the control pressure chamber 33*c* by means of a through-bore 69 that extends transversely in the first piston 12*c*. On a side facing the control pressure chamber 33*c*, the control piston 29*c* has an annular abutment 70. The reset spring 34*c* rests against the annular abutment 70 and the delimiting surface 32*c*, and extends around the first piston 12*c*. The fourth oil channel 59*c* opens out into the control pressure chamber 33*c*. The control piston 29*c* and the check valve 60 form the closure unit 63*c*. The integrated configuration of the first and second piston/cylinder units 11*c* and 22*c* is extremely space-saving. The overall height of the valve bridge 5*c* can thereby be reduced.

The counter support 10*c* has a stepped configuration, and is provided with an annular abutment 71. A spring element 72, which is embodied as a coil spring, is disposed between the annular abutment 71 and the valve bridge 5*c*. The spring element 72 prevents an inclined positioning of the valve bridge 5*c*, especially if the oil pressure in the oil receiving chamber 49, which is not illustrated in FIG. 4, is too low. The spring element 72 can also be utilized with the preceding embodiments if doing so is advantageous.

Furthermore, the integrated configuration of the first and second piston/cylinder units 11*c* and 22*c* can be combined in any desired manner with the elements of the edge control and the piston controls described in the preceding embodiments.

The engine braking operation will first be described. During the temporary opening of the exhaust valve 3, oil flows through the fourth oil channel 59*c* into the control pressure chamber 53*c*. The check valve 60 prevents the oil from flowing back, so that the exhaust valve 3 is blocked in the temporarily opened position. When at the end of the third stroke the rocker arm again loads the valve bridge 5*c* based on the camshaft control in order to bring the exhaust valve 3 into the completely opened position provided during the fourth stroke, the counter support 10*c* is raised from the first piston 12*c* and releases the gradual shutoff opening 20. The blocking of the control piston 29*c* is thereby released. During the movement of the control piston 29*c* into its upper dead center position, the oil found in the control pressure chamber 33*c* is gradually shut off by the shutoff opening 20 via the through-bore 69 and the first oil channel 21*c*. At the same time, the oil found in the oil pressure chamber 18*c* is gradually shut off by the shutoff opening 20 via the first oil channel 21*c*. Due to the gradual shut off of the oil out of the control pressure chamber 33*c*, the first piston 12*c* also moves into its upper dead center position. During the return stroke of the rocker arm, the shutoff opening 20 is again closed off by the counter support 10*c*. The counter support 10*c* pushes the first piston 12*c* and the control piston 29*c* back, whereby the displaced oil can flow off as with the preceding embodiments. The EVB-play is adjusted.

In the normally fired engine operation, the control piston 29*c* is in its upper dead center position and closes off the fourth oil channel 59*c*. The valve play compensation of the exhaust valve 3 can be effected in the already described manner. With regard to the further operation of the valve auxiliary control unit (second piston/cylinder unit 22*c*) and the valve play compensation mechanism (fourth piston/cylinder unit), which is not illustrated in FIG. 4, reference is made to the preceding embodiments.

Figure 5:
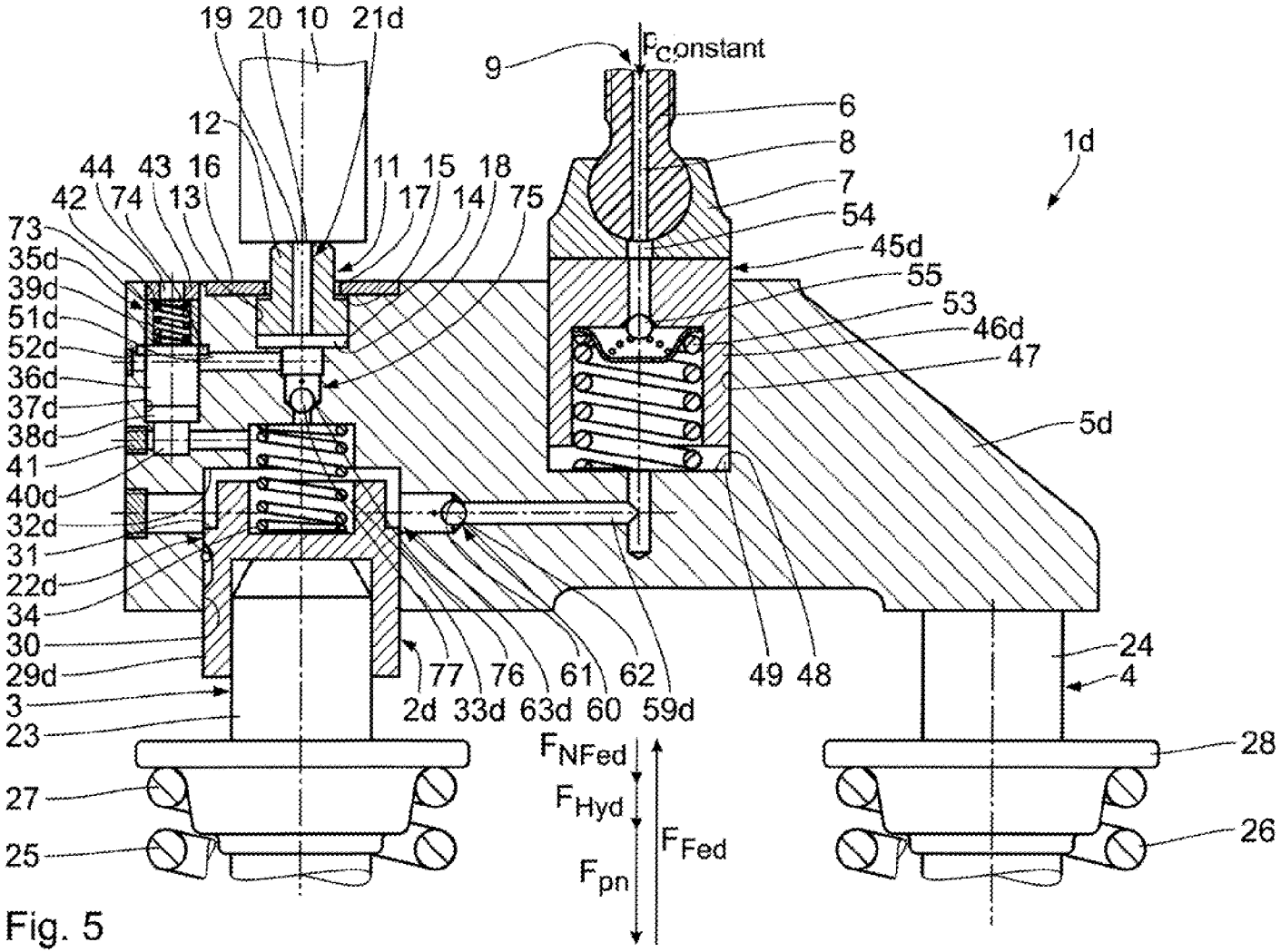
FIG. 5 is a cross-sectional illustration of a valve auxiliary control unit and a valve play compensation mechanism pursuant to a fifth exemplary embodiment of the present application.

A fifth embodiment of the invention will be described subsequently with the aid of FIG. 5. Structurally identical components have the same reference numerals as with the preceding embodiments, to the description of which reference is hereby made. Structurally different, yet functionally identical components have the same reference numerals, followed by the letter d. One difference from the first embodiment is that the first piston/cylinder unit 35*d* is not disposed between the exhaust valves 3 and 4, but rather on a side of the exhaust valve 3 that faces away from the exhaust valve 4, and in a region laterally adjacent the first piston/cylinder unit 11. The third piston/cylinder unit 35*d* is thus displaced outwardly beyond the region loaded by bending moments during the actuation of the exhaust valves 3,4. The third piston 36*d* has a cylindrical configuration and in its upper dead center position rests against a hollow cylindrical abutment sleeve 73, which is inserted into the third cylindrical bore 37*d*. The third oil channel 51*d* connects the first piston/cylinder unit 11 with the third piston/cylinder unit 35*d*. For this purpose, the third oil channel 51*d* proceeds from the first oil channel 21*d* and extends below the oil pressure chamber 18 to the third piston/cylinder unit 35*c*, where it opens out into the third cylinder bore 37*d* in the vicinity near the abutment sleeve 73. In this region, the third piston/cylinder unit 35*d* has a circumferential groove 74 that connects the third oil channel 51*d* with the rear oil receiving chamber 39*d*. Disposed in the first oil channel 21*d*, between the third oil channel 51*d* and the control pressure chamber 33*d*, is a check valve 75 that operates in a blocking manner in the direction of the control pressure chamber 33*d*. The check valve 75 has a valve seat 76 that is formed in the first oil channel 21*d* and can receive a ball 77. In contrast to the first embodiment, with the fifth embodiment, in conformity to the third embodiment, the gradual shutoff opening 56, the through-bore 57, and the check valve 60 are eliminated. The fourth oil channel 59*d* connects the oil receiving chamber 49 directly with the control pressure chamber 33*d*. In conformity with the preceding embodiments, a check valve 60 can additionally be disposed in the fourth oil channel 59*d*.

The engine braking operation will first be described. During the temporary opening of the exhaust valve 3, the movement of the control piston 29*d* produces an underpressure in the control pressure chamber 33*d* by means of which the oil is drawn out of the oil receiving chamber 49 via the fourth oil channel 59*d*. The check valve 75 prevents an oil flow from the oil pressure chamber 18 to the control pressure chamber 33*d*. The oil flowing out of the oil receiving chamber 49 flows in subsequently via the oil supply channels 8, 54 and the check valve 55. In the temporarily opened position, the third piston 36*d* is pressed into its upper dead center position by means of the second oil channel 40*d*. The third piston 36*d* thus rests against the abutment sleeve 73 and closes off the third oil channel 51*d* and the circumferential groove 74. This operating situation is shown in FIG. 5. Due to the fact that no oil can any longer flow off out of the control pressure chamber 33*d*, the exhaust valve 3 is blocked in the temporarily opened position. When at the end of the third stroke the rocker arm again loads the valve bridge 5*d* based on the camshaft control in order to bring the exhaust valve 3 into the completely opened position provided during the fourth stroke, the first piston 12 is raised from the counter support 10, thereby releasing the gradual shutoff opening 20. The oil found in the control pressure chamber 33*d* can now flow off through the shutoff opening 20 via the check valve 75, which permits an oil flow in the direction of the control opening 20, thereby releasing the blocking of the control piston 29*d*, which moves back into its upper dead center position. In this position, the control piston 29*d* closes off the fourth oil channel 59*d*. The control piston 29*d* thus forms the closure unit 63*d*. At the same time, the first piston 12 moves into its upper dead center position, and the third piston 36*d* moves into its lower dead center position by means of the return spring 42, since the oil found in the forward oil receiving chamber 38*b* can flow off through the gradual shutoff opening 20 via the second oil channel 40*d* and the first oil channel 21*d*.

During the return stroke of the rocker arm, and after the renewed contact closure between the counter support 10 and the first piston 12, the gradual shutoff opening 20 is closed off and the first piston 12 is pushed back in the direction of its upper dead center position until the valve bridge 5*b* is in its upper dead center position. The oil pressure chamber 18 is gradually shutoff via the third oil channel 51*d*, the third circumferential groove 74, the rear oil receiving chamber 39*d*, and the oil discharge opening 44. The circumferential groove 74 enlarges the discharge cross-section of the oil, and serves for the precise control of the oil discharge. Since the check valve 75 prevents an oil flow from the oil pressure chamber 18 via the second oil channel 40*d* to the forward oil receiving chamber 38*d*, the third piston 36*d* remains in its lower dead center position. At the end of the fourth stroke, the counter support 10 again rests against the first piston 12, and the rocker arm has again reached the cam base circle. The EVB-play is compensated for, and a new braking cycle can begin.

In the normally fired engine operation, the control piston 29*d* is in its upper dead center position, so that the control piston 29*d* acts as the closure unit 63*d* for the fourth oil channel 59*d*. The oil pressure produced in the oil receiving chamber 49 by the stroke movement of the rocker arm cannot move the control piston 29*d* out of its upper dead center position, and thus cannot open the fourth oil channel 59*b*. Thus, the exhaust valve 3 and the valve bridge 5*d* have a defined position for the valve play compensation. The valve play compensation is effected in the already described manner, whereby a stroke movement of the fourth piston 46*d* is needed only for the valve play compensation. In comparison to the first embodiment, the gradual shutoff of the oil during the compensation of the EVB-play is effected directly via the third piston/cylinder unit 35*d*, and not via the valve play compensation mechanism (fourth piston/cylinder unit 45*d*). Furthermore, the third piston/cylinder unit 35*d* is actuated only by the overpressure in the control pressure chamber 33*d* after the temporary opening of the exhaust valve 3, and is correspondingly independent of the valve play compensation mechanism 45*d*. Due to the fact that the third piston/cylinder unit 35*d* is merely connected with the first piston/cylinder unit 11 and the valve auxiliary control unit 22*d*, the third piston/cylinder unit 35*d* can be displaced laterally outwardly out of the region between the exhaust valves 3 and 4 that is loaded by bending moments. The blocking of the exhaust valve 3 in the temporarily opened position also functions with small jump strokes of the exhaust valve 3 when the difference in diameters between the first piston 12 and the third piston 36*d* is great, so that during the opening process of the third piston 36*d*, the oil loss via the third oil channel 51*d* and the second oil channel 40*d* is low. The circumferential groove 74 furthermore serves the purpose of allowing as little oil as possible to discharge and to become lost during the closure of the third oil channel 51*d* due to the third piston 36*d*, since in this way the stroke length or lift of the third piston 36*d* can be minimized. With regard to the further operation of the valve auxiliary control unit 22*d* and the valve play compensation mechanism (fourth piston/cylinder unit 45*d*) reference is made to the preceding embodiments.

Figure 6:
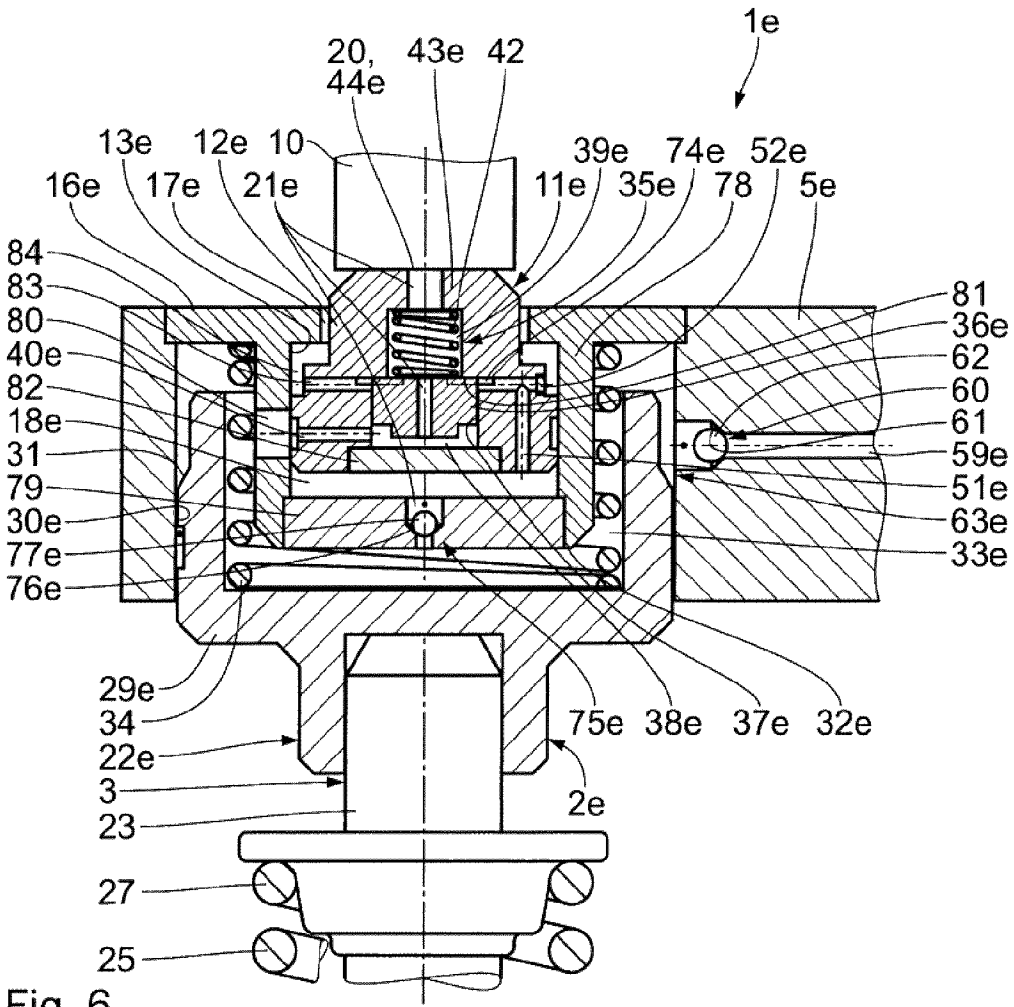
FIG. 6 is a cross-sectional illustration of a valve auxiliary control unit pursuant to a sixth exemplary embodiment of the present application.
Figure 7:
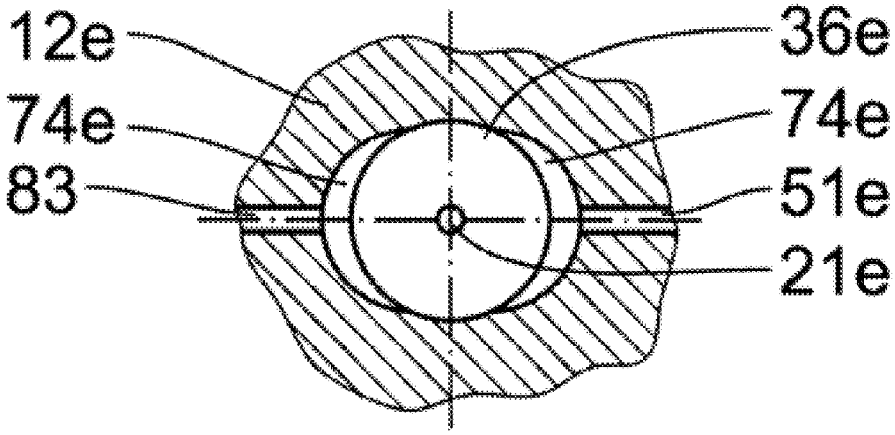
FIG. 7 is a partial cross-sectional illustration of the valve auxiliary control unit of FIG. 6.

A sixth embodiment of the invention will be described subsequently with the aid of FIGS. 6 and 7. Structurally identical components have the same reference numerals as with the preceding embodiments, to the description of which reference is hereby made. Structurally different, yet functionally identical components have the same reference numerals, followed by the letter e. The essential difference relative to the preceding embodiments, especially the first and fifth embodiments, is that the first piston/cylinder unit lie is integrated with the second piston/cylinder unit (valve auxiliary control unit 22*e*) and the third piston/cylinder unit 35*e*. The first piston 12*e* is axially movably guided in a hollow cylindrical auxiliary part 78, which is monolithically formed with the threaded disk 16*e*. Alternatively, the auxiliary part 78 can also be monolithically formed with a pressed-in disk that is pressed into the valve bridge 5*e*. The first piston 12*e* is guided in the hollow auxiliary part 78. The control piston 29*e*, which has an H-shaped cross-section, surrounds the auxiliary part 78, whereby the reset spring 34 is disposed between the auxiliary part 78 and the control piston 29*e*. On a side facing away from the disk 16*e*, the auxiliary part 78 is closed off by a further disk 79 that is threaded or pressed in. A portion of the first oil channel 21*e* with the check valve 75*e* is formed in the disk 79. The auxiliary part 78 has a through-bore 80, which is part of the second oil channel 40*e*.

The third piston/cylinder unit 35*e* is integrated into the first piston 12*e*. For this purpose, the cylinder bore 37*e* for the third piston 36*e* is formed in the first piston 12*e*. The gradual shutoff opening 20 at the same time forms the oil discharge opening 44*e*, whereby the region of the first piston 12*e* that is disposed about the oil discharge opening 44*e* acts as the abutment element 43*e* for the return spring 42.

Furthermore, the cylinder bore 37*e* is provided with an annular abutment 81 for the third piston 36*e*. On a side facing away from the gradual shutoff opening 20, the cylinder bore 37 is closed off by a closure disk 82 that is threaded or pressed in. A portion of the first oil channel 21*e* is formed as a through-bore in the third piston 36*e*, so that the forward oil receiving chamber 38*e* is connected with the rear oil receiving chamber 39*e*. The second oil channel 40*e* is formed in the first piston 12*e* in the region of the closure disk 82 and connects the forward oil receiving chamber 38*e* with the control pressure chamber 33*e* via the through-bore 80. The third oil channel 51*e* has an L-shaped configuration and connects the oil pressure chamber 18*e* with the rear oil receiving chamber 39*e*, whereby the third oil channel 51*e* opens out in the region of the annular abutment 81, so that the latter can be closed off by the third piston 36*e* when it is in its upper dead center position. Across from the third oil channel 51*e*, near the annular abutment 81, a gradual shutoff bore 83 is formed that connects the rear oil receiving chamber 39*e* with an annular gap 84 that is formed between the auxiliary part 78 as well as the disk 16*e* and the first piston 12*e*. The third oil channel 51*e* is closed off relative to the annular gap 84 by the plug 52*e*. The circumferential groove 74*e* is disposed in a region of the annular abutment 81. The circumferential groove 74*e* extends only along a portion of the periphery of the third piston 36*e*, and is thus interrupted on both sides of the third oil channel 51*e* and the gradual shutoff bore 83, so that the third oil channel 51*e* and the shutoff bore 83 are not interconnected by the circumferential groove 74*e* when the third piston 36*e* is in its upper dead center position. FIG. 7 shows a partial cross-section through the first piston 12*e* at the level of the annular abutment 81. As can be seen from FIG. 7, the circumferential groove 74*e* is embodied in the form of two half moons, whereby one of them is in communication with the third oil channel 51*e* and the other is in communication with the gradual shutoff bore 83. In its upper dead center position, the third piston 36*e* prevents a flow of oil from the third oil channel 51*e* to the shutoff bore 83. In conformity with the fifth embodiment, the circumferential groove 74*e* serves to increase the discharge cross-section of the oil and for the precise control of the oil discharge. The shutoff bore 83 can be closed off when the third piston 36*e* is in its upper dead center position. In conformity with the preceding embodiments, the check valve 60 is disposed in the fourth oil channel 59*e*. The fourth piston/cylinder unit, which is not illustrated in FIG. 6, is, for example, embodied in conformity with the fifth embodiment.

The engine braking operation will first be described. During the temporary opening of the exhaust valve 3, the movement of the control piston 29*e* in the control pressure chamber 33*e* produces an underpressure by means of which the oil is drawn out of the oil receiving chamber 49 of the fourth piston/cylinder unit 45*e* via the fourth oil channel 59*e*. The oil flowing out of the oil receiving chamber 49 flows via the oil supply channels 8, 54 and the check valve 55 in the manner already described. The check valve 75*e* prevents a flow of oil from the oil pressure chamber 18*e* to the control pressure chamber 33*e*. In the temporarily opened position, the control piston 29*e* presses the third piston 36*e* into its upper dead center position via the second oil channel 40*e*, so that it closes off the third oil channel 51*e* and the gradual shutoff bore 83. This operating situation is shown in FIG. 6. Due to the fact that no oil can any longer flow out of the control pressure chamber 33*e*, the exhaust valve 3 is blocked in the temporary opened position. When at the end of the third stroke the rocker arm again loads the valve bridge 5*e* based on the camshaft control in order to bring the exhaust valve 3 into the completely opened position provided during the fourth stroke, the counter support 10 is raised from the first piston 12*e*, as a result of which the gradual shutoff opening 20 is released. The oil found in the control pressure chamber 33*e* can now flow off via the second oil channel 40*e* and the first oil channel 21*e* as well as via the check valve 75*e*, the third oil channel 51*e*, and the first oil channel 21*e* through the shutoff opening 20, since simultaneously the first piston 12*e* moves into its upper dead center position and the third piston 36*e* moves into its lower dead center position due to the return spring 42. Consequently, the blocking of the control piston 29*e* is released, so that it moves back into its upper dead center position. In this position, the fourth oil channel 59*e* is closed off by the control piston 29*e*. The control piston 29*e* thus forms the closure unit 63*e*.

During the return stroke of the rocker arm and after the renewed contact closure between the counter support 10 and the first piston 12*e*, the gradual shutoff opening 20 is closed off and the first piston 12*e* is pushed back in the direction of its lower dead center position until the valve bridge 5*e* is in its upper dead center position. The oil displaced out of the oil pressure chamber 18*e* is gradually shut off via the third oil channel 51*e*, the shutoff bore 83 and the annular gap 84. At the end of the fourth stroke, the counter support 10 again rests against the first piston 12*e*, and the rocker arm has again reached the cam base circle. In this connection, the check valve 75*e* prevents an undesired build up of pressure in the control pressure chamber 33*e*, and hence a movement of the third piston 36*e* into its upper dead center position, the result of which would be a closing of the shutoff bore 83. The EVB-play is compensated for, and a new braking cycle can begin.

In the normally fired engine operation, the control piston 29*e* is in its upper dead center position, so that the control piston 29*e* acts as a closure unit 63*e* for the fourth oil channel 59*e*. The oil pressure produced in the oil receiving chamber 49 based on the stroke movement of the rocker arm cannot move the control piston 29*e* out of its upper dead center position, and thus the fourth oil channel 59*e* cannot open. Thus, the exhaust valve 3 and the valve bridge 5*e* have a defined position for the valve play compensation, which is effected in the manner already described. With regard to the further operation of the valve auxiliary control unit (second piston/cylinder unit 22*e*) and the valve play compensation mechanism (fourth piston/cylinder unit), which is not illustrated in FIG. 6, reference is made to the preceding embodiments, especially to the fifth embodiment.

The specification incorporates by reference the disclosure of German priority document DE 10 2008 032 773.5 filed Jul. 11, 2008 as well as 10 2008 061 412.2 filed Dec. 10, 2008.

The present invention is, of course, in no way restricted to the specific disclosure of the specification and drawings, but also encompasses any modifications within the scope of the appended claims.

What I claim is:

1. An internal combustion engine having at least one exhaust valve for withdrawal of exhaust gas from at least one combustion chamber, comprising:

an engine brake device that is provided with a hydraulic valve auxiliary control unit, wherein said valve auxiliary control unit is connected to an oil circuit for a supply of oil, and wherein when said engine brake device is actuated, said at least one exhaust valve is adapted to be held in a temporarily opened position by means of said valve auxiliary control unit;

a connection mechanism for connection of said at least one exhaust valve to a rocker arm, wherein said valve auxiliary control unit is integrated into said connection mechanism;

a hydraulic valve play compensation mechanism for said at least one exhaust valve, wherein said valve play compensation mechanism is integrated into said connection mechanism, and wherein said valve play compensation mechanism is connected to said oil circuit for a supply of oil;

an oil channel that is formed between said valve auxiliary control unit and said valve play compensation mechanism for a supply of oil to said valve auxiliary control unit;

a closure unit, wherein said oil channel is adapted to be closed by said closure unit to effect compensation of valve play of said at least one exhaust valve;

a valve bridge, wherein said valve auxiliary control unit and said valve play compensation mechanism are integrated into said valve bridge, and wherein said oil channel is integrated in said valve bridge;

a counter support that cooperates with said valve auxiliary control unit; and a first hydraulic piston/cylinder unit for a compensation of play between said counter support and said valve bridge.

2. An internal combustion engine according to claim 1, wherein said first hydraulic piston/cylinder unit is connected to said oil circuit, and wherein said first hydraulic piston/cylinder unit is provided with a piston that is integrated into said valve bridge.

3. An internal combustion engine according to claim 1, which further comprises:

a counter support that cooperates with said valve auxiliary control unit, and a spring element that is disposed between said valve bridge (5*c*) and said counter support.

4. An internal combustion engine according to claim 1, wherein said valve auxiliary control unit is embodied as a second hydraulic piston/cylinder unit, and wherein said second hydraulic piston/cylinder unit has a piston that is part of said closure unit.

5. An internal combustion engine according to claim 4, wherein a piston of said first hydraulic piston/cylinder unit is integrally formed with said piston of said second hydraulic piston/cylinder unit.

6. An internal combustion engine according to claim 1, which further comprises a third hydraulic piston/cylinder unit, wherein said valve auxiliary control unit is connected to said valve play compensation mechanism by means of said third hydraulic piston/cylinder unit.

7. An internal combustion engine according to claim 4, wherein said piston of said second hydraulic piston/cylinder unit is provided with at least one transversely extending through-bore, and wherein said at least one through-bore cooperates with a circumferential groove.

8. An internal combustion engine according to claim 1, wherein said valve play compensation mechanism is embodied as a fourth piston/cylinder unit.

9. An internal combustion engine according to claim 6, wherein said third piston/cylinder unit is disposed on a side of said first piston/cylinder unit that faces away from said valve play compensation mechanism.

10. An internal combustion engine according to claim 6, wherein a piston of said third piston/cylinder is integrally formed with a piston (of said first piston/cylinder unit.

* * * * *